United States Patent [19]

Weiss

[11] 4,020,756

[45] May 3, 1977

[54] BAND CLAMPING DEVICE FOR A MACHINE WRAPPING A BAND, STRIP OR THE LIKE ABOUT PIECE GOODS OR THE LIKE

[75] Inventor: Max Weiss, Jestetten, Switzerland

[73] Assignee: Strapex AG, Hergiswil, Switzerland

[22] Filed: Dec. 12, 1975

[21] Appl. No.: 640,242

[30] Foreign Application Priority Data

Dec. 20, 1974 Switzerland ..... 17004/74

[52] U.S. Cl. ..... 100/26; 100/29; 100/33 PB; 53/198 R

[51] Int. Cl.[2] ..... B65B 13/24

[58] Field of Search ..... 100/26, 29, 32, 33 PB; 53/198 R

[56] References Cited

UNITED STATES PATENTS

| | | | |
|---|---|---|---|
| 3,259,966 | 7/1966 | Canter | 100/29 |
| 3,442,734 | 5/1969 | Ericsson | 100/29 |
| 3,916,779 | 11/1975 | Gutjahr et al. | 100/26 |
| 3,929,063 | 12/1975 | Stromberg et al. | 100/26 |

*Primary Examiner*—Richard E. Aegerter
*Assistant Examiner*—L. Footland
*Attorney, Agent, or Firm*—Werner W. Kleeman

[57] ABSTRACT

A band clamping device for a machine wrapping or strapping a band, strip or the like about piece goods, such as boxes, containers, packages, crates and so forth, especially a plastic band or strip, comprising a stationary clamping jaw and a movable clamping jaw guided for movement towards and away from the stationary clamping jaw. The movable clamping jaw is articulated at an end hinge of a first element of a toggle lever, a second element of which can be pivoted by means of a drive about a further end hinge. Both clamping jaws possess essentially flat clamping surfaces intended to engage at the band and to hold such against the action of a tension or traction force. The connection line between the hinge points of the toggle lever together with the clamping surface of the clamping jaws enclose an acute angle open in the direction of the tension or traction force and the guide of the movable clamping jaw is elastically resilient in such direction.

11 Claims, 3 Drawing Figures

Fig.2
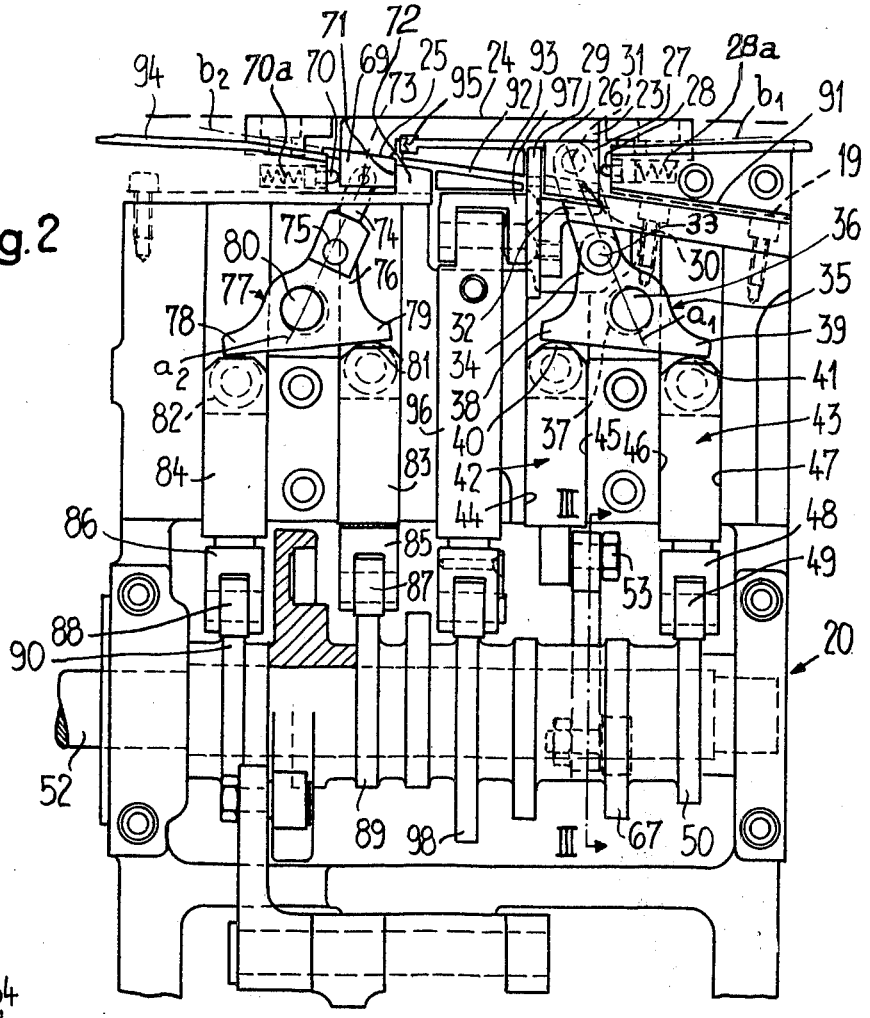
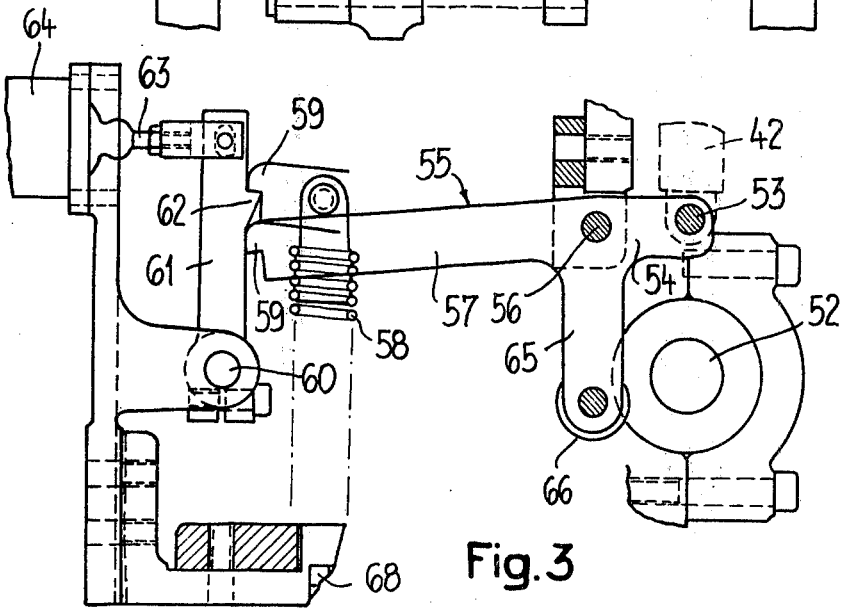
Fig.3

BAND CLAMPING DEVICE FOR A MACHINE WRAPPING A BAND, STRIP OR THE LIKE ABOUT PIECE GOODS OR THE LIKE

BACKGROUND OF THE INVENTION

The present invention broadly relates to the field of strapping machines and, in particular, is concerned with a new and improved construction of a band clamping device for a machine for wrapping or strapping a band, strip, ribbon or the like, especially a plastic band, —hereinafter conveniently referred to as a band— around sundry piece goods, such as typically boxes, crates, containers, cartons packages and so forth.

The strapping machine of the present invention broadly is of the type comprising a fixed or stationary clamping jaw and a movable clamping jaw guided for movement towards and away from the stationary clamping jaw. The movable clamping jaw is articulated at an end hinge of a first element of a toggle lever, a second element of which can be rocked by means of a drive about a further end or terminal hinge. Both clamp or clamping jaws possess essentially flat clamping surfaces engaging at the band and hold such band against the action of traction or tension forces.

Particularly, when working with plastic bands the band clamping device of strapping machines is of special significance. On the one hand, the clamping device should securely hold the tensioned band, i.e., must be capable of withstanding the tension force after completion of the actual band tensioning operation without allowing for any appreciable band slip, and, on the other hand, the band should not be damaged by the clamping operation.

According to a state-of-the-art clamping device of the previously mentioned type, the movable clamp or clamping jaw is subdivided into two sections which are articulated with a respective first element of a toggle lever. The sections of the movable clamp jaw of the prior art device are displaceable along a guide extending at right-angles with respect to the clamping surface of the fixed or stationary clamp jaw. With this known device practically the entire clamping force must be exerted and also maintained by both toggle levers. The traction- or clamping force, which can be resisted by purely a clamping action, is generally dependent upon the product of the coefficient of friction between the band and the clamping jaw surface and the clamping force. On the other hand, with the presently used high tearresistant plastic bands there is strived for a particularly great tension force, but there is only available a relatively low coefficient of friction. Moreover, these plastic bands are comparatively sensitive to external damage inasmuch as their tear resistance rapidly diminishes to unacceptable values when their longitudinal fibrous structure is exposed to external forces. An improvement of the relationship between the tension force and the clamping force by providing the clamping surfaces of the clamp jaws with barb-like protuberances which claw into the band (i.e., a transition from a force locking action to a form locking action between the band and the clamp jaws) is only possible to a limited extent due to the sensitivity of the band as concerns its becoming damaged.

Hence, if the strived for tension force is to be actually realized, then the prior art devices had to have the toggle lever designed and adjusted in such a manner that such toggle lever was capable of producing the requisite clamping force. However, in practice this result can be hardly realized. Either the toggle lever had to be adjusted such that in the clamping position of the movable clamp jaw it was almost completely extended, but due to manufacturing tolerances and also because of thickness tolerances of the band such however was practically not possible. Or else, however, the toggle lever and its drive had to be designed so robustly that even in the case of dimensional deviations of the components of the device and the band there could be produced the required clamping force before attaining the completely extended position of the toggle lever.

SUMMARY OF THE INVENTION

Hence, with the foregoing in mind it is a primary object of the present invention to provide an improved construction of strapping machine which is not associated with the aforementioned drawbacks and limitations of the prior art constructions.

Still another and more specific object of this invention aims at the provision of a novel device of the previously mentioned type wherein with comparatively little expenditure it is possible to extensively comply with the above-discussed requirements, and nonetheless there can be accepted comparatively large tolerances for the dimensions of the components of the device.

A further object of the present invention aims at the provision of a new and improved band clamping device for a strapping machine which allows positive application of the force needed to tension the band without any appreciable marring or damage to the band, while allowing the strapping operation to be carried out relatively easily, quickly and reliably.

Now in order to implement these and still further objects of the invention, which will become more readily apparent as the description proceeds, the invention contemplates that a connection line between the hinge center points of the end hinges of the toggle lever together with the clamping surface of the clamping jaws encloses an acute angle open in the direction of the tension or traction force and that the guide of the movable clamping or clamp jaw is elastically resilient in this direction.

By virtue of this construction there is imparted to the clamp jaws articulated at the first element of the toggle lever an additional self-locking action which increases as a function of the increase of the tension- or clamping force of the band.

The aforementioned acute angle which opens in the direction of the tension or traction force preferably is between 70° and 80°. Additionally it is advantageous if the connection line between the hinge center points of the end hinges of the toggle lever together with the displacement direction of the movable clamp jaw likewise encloses an angle greater than 0°, but less than 30°.

The thickness of the band to be clamped with the device can be taken into account in that the hinge axis of the other end hinge, about which there can be rocked or pivoted the second element of the toggle lever, can be adjusted and fixed in position with regard to its spacing from the fixed or stationary clamping jaw. In this case the second element of the toggle lever can be pivotably mounted upon an eccentric which can be fixed in its rotational position.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 2 is a front view of both clamping devices of FIG. 1 shown on an enlarged scale; and FIG. 3 is a simplified sectional view taken along the line III—III of FIG. 2 illustrating mechanism for the sudden actuation of the toggle lever.

DETAILED DESCRIPTION OF THE PREFERRED EMBODIMENTS

Figure 1:
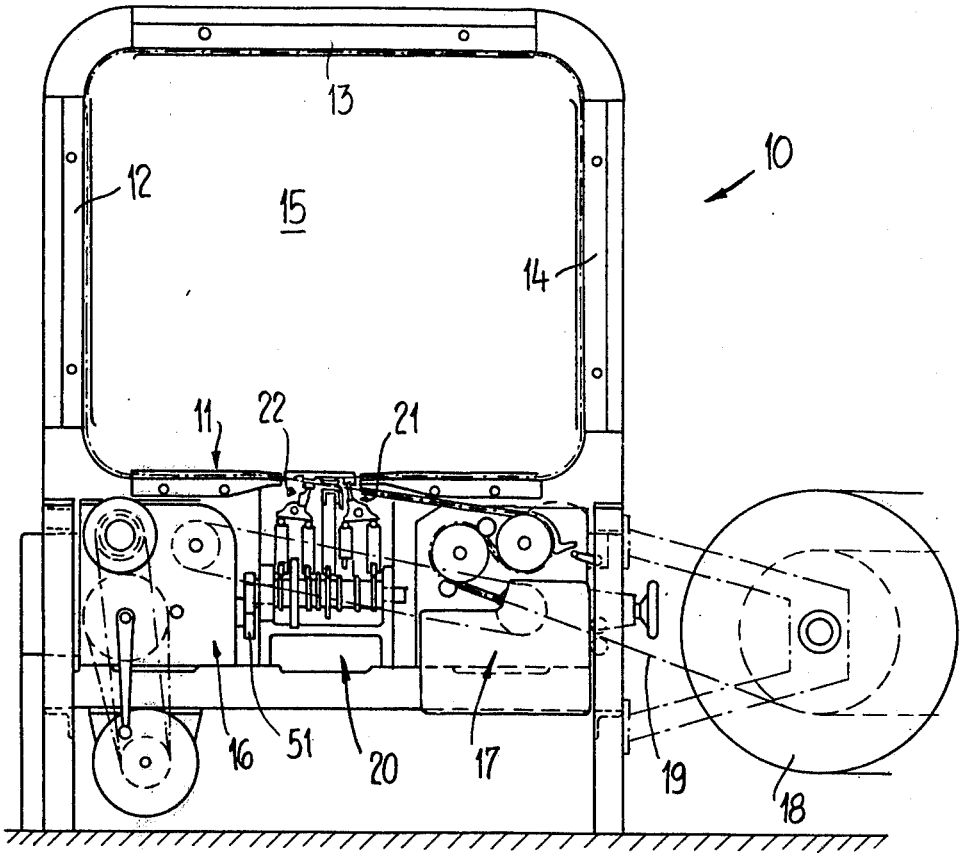
FIG. 1 is a schematic front view of a strapping machine equipped with two band clamping devices.

Describing now the drawings, the strapping machine 10 or the like illustrated in FIG. 1 will be seen to comprise a work table or platform 11, the work surface of which extends at right angles and to both sides of the plane of the drawing. The table 1 has spanned thereover in a gantry-like manner the band guides or guide members 12, 13 and 14 which leave a work opening 15 free into which there can be introduced the piece goods, i.e., objects or articles which are to be strapped. The term "piece goods," whether the same be used in the singular or plural, is intended to mean the articles or objects to be tied together by a band or the like regardless of the nature of such goods. Typically, but by no means exclusively, with the strapping machine of the invention there may be bound articles or objects such as boxes, crates, containers, packages and so forth. Continuing, below the work surface of the table 11 there is arranged a drive unit or drive 16, a feed and tensioning drive or transmission 17 for the band or tape 19 payed-off a supply roll 18, and a work unit or device 20 arranged between the drive unit 16 and the drive or transmission 17. This work unit 20 —stated in a simplified manner— is assigned the task, following the feed of the band or tape of fixedly holding the leading end of the band, then again retracting the band (such thereby slips out of the guides 12, 13, and 14 as well as out of the band guides provided in the table surface) and also to tension such about the article to be strapped and thereafter to also fixedly hold the trailing section of the band 19, to then cut the band 19 at the region of the trailing section, and thereafter interconnecting both ends of the band with one another. For this purpose the work unit 20 is provided with two bands clamping devices 21 and 22, further details of which will be considered hereinafter with respect to FIG. 2.

Turning attention to FIG. 2, the work unit 20 illustrated therein will be recognized to comprise a retractable plate or plate member 23 of essentially L-shaped configuration in cross-section. The upper side 24 of plate 23 is approximately flush with the work surface of the work table 11. The lower side of this plate 23, namely the end surface of the one leg and the end of the other leg are constructed as stationary clamp or clamping jaws 25, 26 arranged in spaced relationship from one another.

Coacting with the stationary clamp jaw 26 is a movable clamp or clamping jaw 27 displaceable in a predetermined direction towards and away from the stationary clamp jaw 26 and which, in cross-section, possesses an essentially trapezoidal configuration. This movable clamp jaw 27 is forced under the action of a presser 28 loaded by a spring 28*a*, to bear at a guide plate 29 oriented essentially at right angles to the clamp jaw 26. The clamp or clamping jaw 27, the body of which is provided with a passageway or opening 30 for the trailing section of the band 19, is articulated by means of a movable hinge pin 31 or equivalent structure at the one end of a bracket or link 32 or at the one end of a pair of identical brackets or links. The other end of the bracket or brackets 32 is articulated by means of a hinge pin or intermediate hinge 33 or the like at the one arm 34 of a triple-arm rocker or balance 35 which, in turn, is pivotable about a stationary pivot pin 36 which, however, can be adjusted and fixed in position in accordance with the thickness of the band 19. As indicated by means of the broken lines 37 the pivot pin 36 is constructed as an eccentric or eccentric member, so that by rotating the eccentric there can be varied the spacing of the pivot axis of the rocker or balance 35 with respect to the stationary clamp jaw 26. The balance or rocker 35 and in particular its arm 34 and the bracket or link 32 hingedly supported thereby form both elements of a toggle lever or equivalent structure, the end or terminal hinges of which are constituted by the pin 31 and the pivot pin 36.

The ends of both other arms 38 and 39 of the balance 35 bear, for instance, through the agency of rollers 40 and 41, upon the upper ends of a plunger 42 and 43 respectively. Both the plunger 42 as well as the telescopically resiliently constructed plunger 43 are guided to be lengthwise displaceable in guides 44, 45 and 46, 47, respectively. The resilient plunger 43 carries at its lower end a roller or roll 49 rotatably mounted in a forked or bifurcated member 48. Roller 49 in turn bears upon a cam 50 which is fixedly seated for rotation upon a cam shaft 52 driven by the drive unit 16 through the agency of a transmission or intermediate gear 51 (FIG. 1). From what has been explained above it should be apparent that upon raising the plunger 43 the balance 35 is rocked in counterclockwise direction, the toggle lever bent and the movable clamp jaw 27 spaced from its stationary counter element.

Since during operation of the strapping machine 10 there should occur the opposite movement of this toggle lever, i.e., the extending or extension thereof directly after arrival of the leading end of the band in the work unit 20 (after passing the guides 30, 12, 13 and 14); there is provided another actuation mechanism for the plunger 42 which will be described in conjunction with FIG. 3.

The lower end of the plunger 42 is articulated or hingedly connected through the agency of a bolt 53 or the like at the end of a first arm 54 of a triple-arm lever 55 which in turn can be rocked about a stationary shaft 56. At the end of a second arm 57, which is longer than the first arm 54, there is attached one end of a tension spring 58 and additionally there is formed a locking nose 59. The locking nose 59 cooperates with a pawl tooth or latch 62 provided at a pivotal lever 61 pivotably mounted at location 60. The free end of the pivotal lever 61 is hingedly coupled with a traction or pull rod 63 of a traction or pull magnet 64. This traction rod 63, in the deenergized state of the magnet 64, is resiliently pre-biased into its extended position. A roller or roll 66 is rotatably mounted at the end of a third arm 65 of the triple-arm lever 55. This roller 66 in turn cooperates with a cam 67 (FIG. 2) seated upon the shaft 52. From the above discussion it will be apparent that as soon as the locking nose 59 is released due to the action of the magnet 64 and the pawl tooth 62 at the pivotal lever 61, the triple-arm lever 55 is rocked suddenly in counterclockwise direction under the action of the traction or tension spring 58. Consequently, the plunger 42 is likewise suddenly or immediately raised, resulting in a rocking of the balance 35 in the clockwise direction and hence an extension of the toggle lever, i.e., a displacement of the movable clamp jaw 27 into its clamping position. The clamping force which comes into play is initially essentially only dependent upon the traction or tension spring 58, the lower end of which is preferably suspended at an anchoring element 68 which can be displaced in the traction or tension direction and fixed in position.

It should be understood that during the described operation the rotational position of the cams or cam disks 50 and 67 which only rotate during the closure operation is such that there is possible a lowering of the plunger 43 and a rocking of the triple-arm lever 55. Furthermore, it is to be appreciated that the first clamping device, designated by reference character 21 in FIG. 1, encompasses the components 26 to 68 inclusive of FIG. 2. As concerns the excitation of the traction or pull magnet 64 such will be considered at a later point of this disclosure.

The second clamp means or clamp device, designated by reference character 22 in FIG. 1, is essentially constructed analogous to the clamping device 21, wherein in the embodiment under discussion there is a minor rather insignificant difference. Hence, it should be satisfactory to only briefly consider this second clamping device, particularly as regards the changes.

Reference character 69 designates the movable clamp or clamping jaw which is displaceable in a predetermined direction towards and away from and cooperating with the stationary clamp or clamping jaw 25. This movable clamp jaw 69 can be shifted to-and-fro along the guide surface 71 of a guide block 72 by means of a presser 70 biased or loaded by a spring 70*a*. The clamp jaw 69 is articulated at movable end hinge 73 at the one end of a bracket or link 74 which is hingedly supported or coupled via an intermediate hinge 75 at the one end arm 76 of a triple-arm balance or rocker 77 pivotably mounted at 80. The pin 80 is likewise constructed as an eccentric which can be adjusted and fixed in rotational position in accordance with the thickness of the band 19. The further arms 78, 79 of the balance or rocker 77 bear against rollers 82, 81, respectively, which, in turn, are rotatably mounted at the upper ends of displaceably guided plungers 84, 83, respectively, the plunger 84 in this case being constructed to be telescopically resilient. Both plungers 83 and 84 carry at their lower end a respective forked or bifurcated member 85 and 86 at which there is rotatably supported a further roller 87 and 88 respectively. Each of the rollers 87 and 88 constitutes a cam follower of a cam or cam disk 89 and 90 respectively, which, in turn, are fixedly seated for rotation upon the rotatable shaft 52. The difference in the construction of the clamping device 21 thus essentially resides in the fact that in this case the movement of both plungers 83 and 84 in both directions is controlled by the cams 89 and 90, respectively, which, in turn, must be constructed in such a manner that during the stroke of the one plunger there is permitted a corresponding lowering of the other plunger. The clamp or clamping device 22 of FIG. 1 hence encompasses the components 25 and 69 to 90 inclusive.

While with the illustrated clamping devices the control of the movement of the toggle lever, formed by the bracket 32 and the balance 35 as well as the bracket 74 and the balance 77, is positively controlled both during extension as well as bending of the toggle lever, it should be appreciated that in one direction this movement could be likewise triggered by a return or restoring spring or equivalent structure.

Having now had the benefit of the foregoing discussion there will be considered the mode of operation of both of the clamp or clamping devices 21 and 22 which are part of the band or tape strapping or tying machine. Initially due to the feed- and tensioning drive or transmission the band 19 is advanced with its leading end through a guide groove 91 (FIG. 2) through the passageway or opening 30, through a further guide groove 92 in a block 93 arranged between both of the clamping devices, then through and between the clamp jaws 25 and 69 into the guide 94 formed in the work surface of the table 11. From this location this band 19 moves through the guides 12, 13 and 14 (FIG. 1) until it moves between and through the clamp jaws 26 and 27 and wipingly past the upper side of the block 93 and arrives at the actuation lever 95 of a not particularly illustrated but conventional microswitch. As a result, and among other operations, the traction or pull magnet 64 is energized and the clamp device 21 suddenly closes i.e. the clamp jaw 27 moves towards the stationary clamping or clamp jaw 26. Hence, the band 19 is initially fixedly clamped at the region of its leading end which has traveled onto the actuation lever 95. Now the strapping machine is in a condition preparatory for receiving an article which is to be strapped or tied. Now the drive of the feed- and tensioning transmission or drive 17 (FIG. 1) is reversed, i.e., the band 19 is again pulled back in a direction opposite to its normal feed direction, and the band is tensioned about the article (not shown) located in the work opening 15. As soon as there has been reached the desired tension, then the shaft 52 is also placed into rotation, and, consequently, the plunger 84 initially is lowered and the plunger 83 raised. As a result, the band is also fixedly clamped at the region of its trailing end. The sections of the band located between both of the clamping or clamp devices 21 and 22 are now practically free of tension since the total traction force is taken up by both of the clamping devices 21 and 22. At this point in time and with the aid of not particularly illustrated means the block 93 and the actuation lever 95 are retracted in a direction which is at right angles to the plane of the drawing and a cutting punch 97 secured at the upper end of a further plunger 96 is raised by means of a further cam or cam disk 98 so that the trailing section of the band is cut. Thereafter, the leading end and trailing end of the band are interconnected with one another in any suitable manner and while employing any suitable technique, for instance by welding or heat sealing. Now the strapping operation has been completed and the clamping devices 21 and 22 can be released, so that the strapped article can be removed from the work opening 15.

It is to be observed that with the described apparatus the clamping force initially is only dependent upon the force with which there is actuated the toggle lever. This force is sufficient for frictionally coupling the clamp or clamping jaws with the band or the like. As soon as the tension- or clamping force at the band is capable or overcoming such friction, then the band strives to slipout of the clamping gap between the clamp jaws. Since, however, the movable jaws 27 and 69 are frictionally coupled with the band 19 and, additionally, by virtue of the resilient or spring biased pressers 28 and 70, respectively, are movable in the direction of the traction force acting essentially in the planes $b_1$ and $b_2$ respectively, they participate in the movement of the band. With this movement of the jaws 27 and 69 in the plane of the clamping surfaces there occurs a large increase of the clamping force, because the connection lines $a_1$ and $a_2$ (FIG. 2) between the end hinges of both toggle levers with the planes of the clamping surfaces indicated by reference characters $b_1$ and $b_2$ respectively enclose an acute angle, preferably between 70° and 80°. The toggle levers are thus self-locking without having to bring them in their completely extended position. Moreover, upon releasing the jaws there is no danger or damaging the band because in any event the movement of the movable clamp jaws is directly away from the stationary clamp jaws.

While there are shown and described present preferred embodiments of the invention, it is to be distinctly understood that the invention is not limited thereto, but may be otherwise variously embodied and practiced within the scope of the following claims. Accordingly,

What is claimed is:

1. A band clamping device for a machine for strapping articles by means of a band, especially a plastic band, comprising a stationary clamp jaw, a movable clamp jaw, means for guiding the movable clamp jaw for movement in a predetermined displacement direction towards and away from the stationary clamp jaw, a toggle lever having a first element and a second element, means defining a first movable end hinge of the first element for hingedly connecting the movable clamp jaw at the first element, means defining an intermediate hinge for hingedly connecting the first element with the second element, means defining a second end hinge for hingedly supporting said second element, drive means for pivoting said second element about said second end hinge, both of said clamp jaws possessing essentially flat clamping surfaces for engagement with the band and for fixedly holding the band against traction forces, essentially acting in the direction of a plane containing said clamping surfaces, the connection line between the hinge center points of the end hinges of the toggle lever together with the clamping surfaces of the clamp jaws enclosing an acute angle which opens in the direction of the traction force, said means for guiding the movable clamp jaw being structured to be elastically resilient in said direction of the traction force.

2. The band clamping device as defined in claim 1, wherein said drive includes a lever, a pawl for freeing said lever, a spring for biasing said lever, said second element of the toggle lever being coupled with said lever, said lever when released by said pawl suddenly extending the toggle lever.

3. The band clamping device as defined in claim 1, wherein the connection line between the hinge center points of the end hinges of the toggle lever together with the displacement direction of the movable clamp jaw towards and away from the stationary clamp jaw encloses an angle greater than 0° but less than 30°.

4. The band clamping device as defined in claim 1, wherein said acute angle which is open in the direction of the traction force is substantially between 70° and 80°.

5. The band clamping device as defined in claim 1, wherein the hinge axis of the second end hinge about which there is pivotable the second element of the toggle lever includes means for adjusting and fixing the spacing of said hinge axis from the stationary clamp jaw.

6. The band clamping device as defined in claim 4, wherein said adjusting means includes an adjustable eccentric, the second element of the toggle lever being pivotably mounted at said eccentric.

7. The band clamping device as defined in claim 1, including a balance, means for pivotably mounting said balance about a stationary axis, said balance having a first arm, said second element of the toggle lever being formed by said first arm of said balance.

8. The band clamping device as defined in claim 6, wherein said balance has two further arms so as to define a triple-arm member, cam drive means, at least one of said further arms being operatively connected with said cam drive means.

9. The band clamping device as defined in claim 7, wherein said further arms define a second arm and a third arm, cam disk means, a respective plunger for connecting each said second arm and third arm with said cam disk means.

10. The band clamping device as defined in claim 6, wherein said drive means includes a lever, a pawl for freeing said lever, a spring for biasing said lever, said second element of the toggle lever being coupled with said lever, said lever when released by said pawl suddenly extending the toggle lever, said balance having two further arms defining a second arm and a third arm, a cam disk, said second arm of the balance being connected with said lever, a plunger, said third arm of the balance being connected via said plunger with the cam disk.

11. A clamping device for a machine for strapping articles by means of a band, comprising a stationary clamp jaw, a movable clamp jaw, means for guiding the movable clamp jaw for movement towards and away from the stationary clamp jaw, toggle lever means having a first element and a second element, means defining a first movable end hinge of the first element for hingedly connecting the movable clamp jaw at the first element, means defining an intermediate hinge for hingedly connecting the first element with the second element, means defining a second end hinge for hingedly supporting said second element, drive means for rocking said second element about said second end hinge, both of said clamp jaws possessing clamping surfaces for engagement with the band and for fixedly holding the band against traction forces effective essentially in a plane containing said clamping surfaces, the connection line between hinge center points of the end hinges of the toggle lever means together with the clamping surfaces of the clamp jaws enclosing an acute angle which opens in the direction of the traction force.

* * * * *